US005287332A

United States Patent [19]

Lea

[11] Patent Number: 5,287,332

[45] Date of Patent: Feb. 15, 1994

[54] ACOUSTIC PARTICLE ACCELERATION SENSOR AND ARRAY OF SUCH SENSORS

[75] Inventor: John D. Lea, Huntington, N.Y.

[73] Assignee: Unisys Corporation, Blue Bell, Pa.

[21] Appl. No.: 903,428

[22] Filed: Jun. 24, 1992

[51] Int. Cl.[5] ..... H04R 17/00

[52] U.S. Cl. ..... 367/153; 367/155; 367/162; 367/165; 367/173; 367/176; 367/149; 356/345; 356/355

[58] Field of Search ..... 367/162, 165, 173, 176, 367/149, 153, 155; 310/326, 327, 337; 356/345, 355, 356, 357, 358

[56] References Cited

U.S. PATENT DOCUMENTS

| | | | |
|---|---|---|---|
| 4,140,992 | 2/1979 | Wardle | 367/153 |
| 4,158,189 | 6/1979 | Wardle | 367/153 |
| 4,799,752 | 1/1989 | Carome | 367/149 |
| 4,893,930 | 1/1990 | Garrett et al. | 356/345 |
| 4,928,263 | 5/1990 | Armstrong et al. | 367/118 |
| 4,949,317 | 8/1990 | McQuitty et al. | 367/176 |
| 4,982,385 | 1/1991 | Eynck | 367/151 |
| 5,140,559 | 8/1992 | Fisher | 367/149 |
| 5,155,707 | 10/1992 | Fisher | 367/149 |
| 5,212,670 | 5/1993 | Brown | 356/345 |

*Primary Examiner*—J. Woodrow Eldred

*Attorney, Agent, or Firm*—Seymour Levine; Mark T. Starr; Stanton Weinstein

[57] ABSTRACT

An element responsive to acoustic particle acceleration for sensing acoustic signals in a region of low acoustic pressure is disclosed. The element may be isolated from acoustic noise when positioned adjacent an acoustic noise generating high acoustic impedance structure by a baffle which provides isolation from radiated and evanescent acoustic signals and structure vibration.

14 Claims, 5 Drawing Sheets

ACOUSTIC PARTICLE ACCELERATION SENSOR AND ARRAY OF SUCH SENSORS

BACKGROUND OF THE INVENTION

1. Field of the Invention

The invention pertains to the field of acoustic sensor's and more particularly to acoustic sensors responsive to accoustic particle acceleration.

2. Description of the Prior Art

Acoustic sensors in an acoustic sensor array positioned at a source of acoustic noise, which may be a thick vibrating metallic plate, for sensing acoustic signals incident to the region of the noise source are usually isolated from the noise source by an acoustic decoupler or baffle. Generally, such a baffle is a relatively thin layer of material exhibiting a low acoustic impedance, relative to the propagating medium, which covers the entire area in back of the receiving array, e.g. between the array and the noise source, and isolates the array, typically comprising pressure sensitive acoustic sensors, from the acoustic noise emitted from the noise source. Though the low acoustic impedance provides significant attenuation of the radiated noise, its presence adversely affects the signal response of the acoustic sensors in the array.

A pressure wave incident to a low impedance baffle is reflected with an amplitude that is approximately equal to that of the incident wave and a phase that is approximately 1800 from that of the incident wave. The reflected and incident waves add, creating a pressure wave at the acoustic sensor having an amplitude that is significantly lower than that of the incident wave. Since the electrical signal output of the acoustic sensor is a function of the amplitude of the pressure wave at the sensor, the reduced amplitude causes a concomitant reduction in the sensor's electrical signal output and a reduced signal-to-noise ratio from that which would have been provided had the reflection from the baffle not been present. Two solutions to this problem have been implemented. One positions the acoustic sensor array a quarter wavelength from the baffle whereat the reflected wave is in-phase with the incident wave, thus providing a pressure wave amplitude that is greater than that of the incident pressure wave. The second solution interposes a high acoustic impedance between the baffle and the acoustic sensor. Reflections from this high impedance are in-phase with the incident acoustic wave and the resulting pressure wave amplitude at the acoustic sensor is similar to that of the first solution.

Since the acoustic sensors in the first solution are positioned a quarter wavelength from the low impedance baffle, this solution severely limits the frequency bandwidth of the system. Further, the required quarter wavelength standoff requirement increases as the frequency decreases, becoming unacceptable at the low acoustic frequencies.

The second solution requires a massive material interposed between the acoustic noise source and the low impedance baffle to provide the desired high impedance. Typically this massive material is a thick steel plate, the thickness of which, to establish the required impedance level, is inversely proportional to the desired lowest signal frequency in the system spectrum. At the lower acoustic frequencies the steel plate becomes massive and may adversely effect the stability of the noise source, especially if the acoustic sensor array has a large area. Thus, array area and operating frequency, which are inversely proportional for a desired acoustic beamwidth, must be considered in the design of a practical array of pressure sensitive acoustic sensors.

It is therefore an object of this invention to provide an acoustic sensor which does not require a large standoff distance or a massive correction plate to provide an operational acoustic array.

SUMMARY OF THE INVENTION

Acoustic velocity, also known as particle velocity, and its time derivative, acoustic particle acceleration, in a stationary acoustic wave, such as that established by the addition of the wave incident to and reflected from a baffle having a low acoustic impedance relative to the propagating medium, is in spacial quadrature with the standing acoustic pressure wave. Therefore, in regions where the pressure is at a minimum, the particle velocity and acceleration are at a maximum. Consequently, the invention provides an acoustic element which is sensitive to acoustic particle acceleration rather than acoustic pressure.

In accordance with the principles of the invention an acoustic accelerometer for sensing acoustic particle acceleration has a specific gravity substantially equal to that of the surrounding medium so that the device may move with the medium, thus experiencing the acoustic particle acceleration. Additionally, the acoustic accelerometer has a mechanical resonant frequency that is greater than the highest acoustic signal frequency to be sensed, so that resonant vibrations can not occur within the acoustic frequency band of interest.

An acoustic acceleration sensor comprises an accelerometer contained within a medium tight housing. The dimensions of the housing are chosen to provide a specific gravity for the device that is substantially equal to the specific gravity of the surrounding medium, so that the housing vibrates with the vibrations of the surrounding medium. These vibrations are transmitted to the accelerometer within the housing which then provides an electrical signal representative of the accelerations of the acoustic wave causing the vibrations. A suitable internal accelerometer is a disk created by two piezo electric ceramic (PZT) elements. The PZT elements are electrically coupled to be in phase opposition. Thus, in the absence of a PZT deforming acceleration, the output signal, taken across the free terminals of the PZTS, is a minimum. When an acceleration is applied, the inertial mass of the disk causes the disk to deflect in a manner to subject the PZTs to radial tension and compression in opposition, causing the PZTs to generate substantially equal voltages with opposite polarities. Since the PZTs are coupled in phase opposition, the signals of opposite polarity add and provide an output signal that is representative of the acceleration of the surrounding medium.

Another suitable accelerometer for the acoustic acceleration sensor measures acceleration induced differential strain in two fiber optic coils bonded to opposite faces of an annular metallic disc and arranged to establish an optical interferometer. The fiber optic assembly is mounted within an outer annular region whereat the assembly is supported. An acceleration applied normal to the plane of the annulus causes a deflection of the annulus. The optical fiber coil of the interferometer mounted on the surface of the annulus facing the incident acoustic wave is compressed, reducing the radius of the coil, while the optical fiber coil on the opposite surface is elongated, increasing the radius of the coil. These radius changes establish a phase difference between the optical signals in the two branches of the interferometer which is representative of the acoustic particle acceleration.

Further in accordance with the invention a plurality of acoustic acceleration sensors are arranged on a flexural stiff mounting plate which is in turn mounted on the surface of a low acoustic impedance material which acts as a baffle that isolates the the array from acoustic noise or signals incident to the baffle on the side opposite the mounted acoustic acceleration sensors. The acoustic acceleration sensors arrangement on the mounting plate establishes an acoustic phased array capable of receiving acoustic signals within a desired angular region. The arrangement on the mounting plate permits the sensors to respond to the particle accelerations of incident acoustic waves while providing isolation from accelerations due to evanescent waves generated by structures adjacent to the baffle and are transmitted therethrough.

These and other features of the invention will become more apparent from the detailed description below with reference to the accompanying drawings.

DESCRIPTION OF THE PREFERRED EMBODIMENTS

Figure 1:
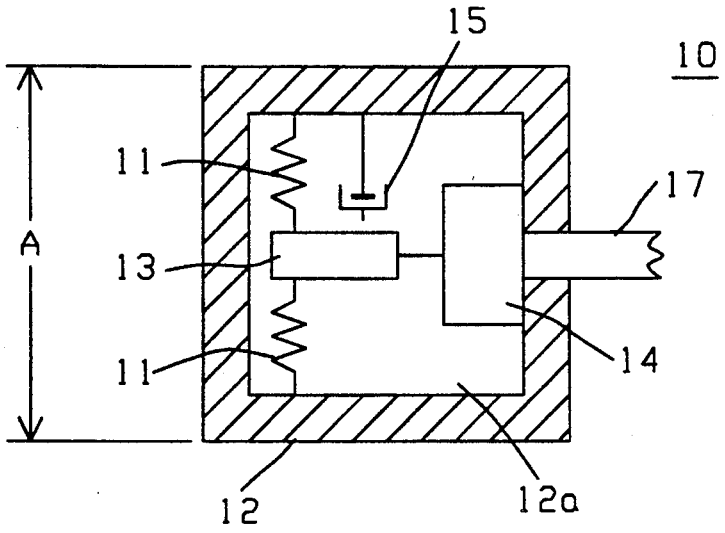
FIG. 1 is a schematic diagram of an acoustic wave particle acceleration sensor.

Refer to FIG. 1, wherein an acoustic particle acceleration sensor 10 is shown schematically. Springs 11, coupled to a housing 12, support a mass 13 which is coupled to deflection transducer 14. The springs 11, mass 13, and transducer 14 are arranged in an inner chamber 12*a* of the housing 12, the outer surfaces thereof being exposed to the surrounding medium. The dimensions of the housing 12 are such that the overall density of the device is no greater than the surrounding medium, so that the acceleration sensor 10 is accelerated with the accelerations induced to the surrounding medium by the acoustic particle accelerations. The acceleration of the housing 12 causes the mass 13 to move in the direction of the acceleration, compressing one of the springs 11 and elongating the other. A dash pot 15 is coupled between the housing 12 and the mass 13 to prevent excess oscillation of the spring 11 and mass 13 assembly. The spring constant for the springs 11 and damping factor of the dash pot 15 are chosen in accordance with the acceleration sensitivity desired. Additional, the housing dimension D is chosen to be small compared to the wavelength of acoustic signal. Movement of the mass 13 is sensed by the deflection transducer 14 wherefrom an electrical signal representative of the mass movement, which is indicative of the acceleration of the device, is coupled to an electrical output line 17.

Figure 2A:
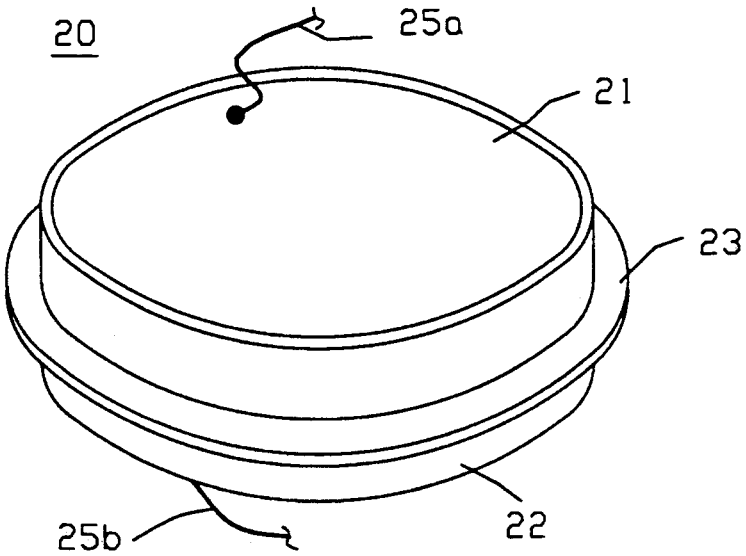
FIGS. 2A–2D are diagrams of an acoustic wave particle acceleration sensor utilizing piezo-electric discs.
Figure 2B:
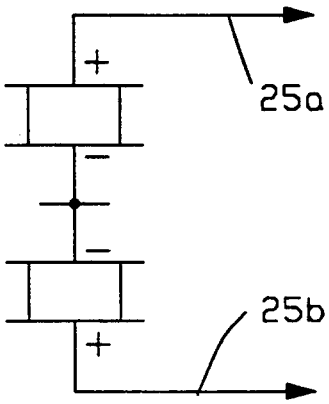
Figure 2C:
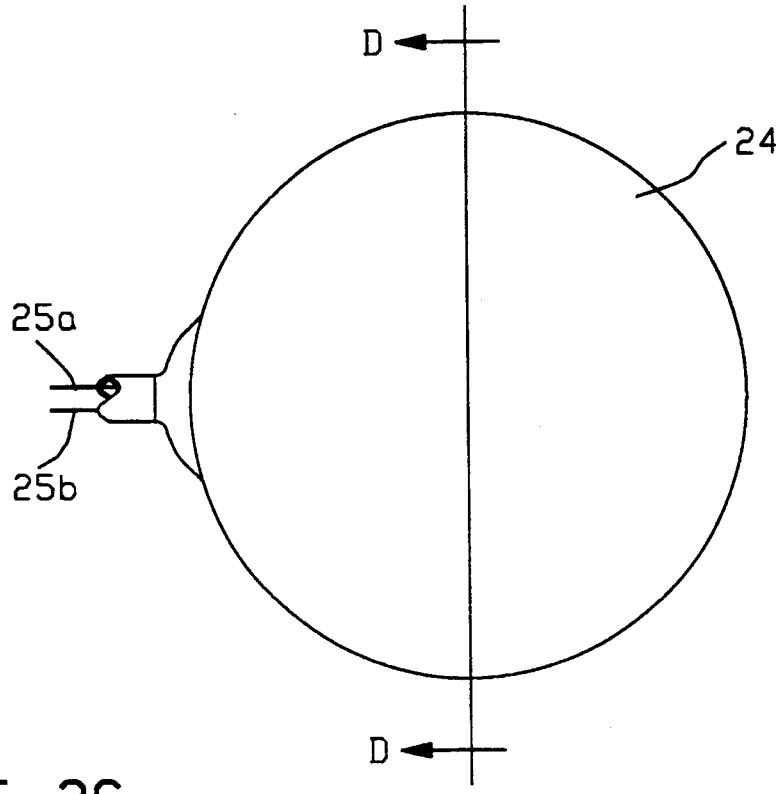

Acoustic particle acceleration sensors are not restricted to lumped constant elements as represented by the FIG. 1 device. A distributed constant element device is shown in FIGS. 2A–2D. A disk assembly 20 is formed by mounting two piezo-electric ceramic (PZT) elements 21 and 22 on a disc 23, which may be constructed of any suitable flexible material. The disk assembly 20 is mounted in a housing 24 by clamping the rim of the disk 23 to the housing 24, as shown in the cross-sectional view provided in FIG. 2D. A top view of the assembled device is shown in FIG. 2C, the dimensions of which, though not shown are chosen to provide an effective density for the entire assembly that is no greater than the density of the surrounding medium. When the housing 24 is accelerated, the motion is transmitted through the rim to the disk 23 The inertial mass of the disk assembly 20 causes the disk 23 to deflect, subjecting the PZTs 21,22 to radial tension and compression forces in opposition. These forces, due to the piezo-electric affect, cause the PZTs to generate a voltage that is proportional to the deflection. The PZTs 21,22 are mounted in electrical phase opposition, as shown in FIG. 2B. This establishes a voltage between electrical leads 25*a* and 25*b* that is twice the voltage generated by each PZT.

Figure 2D:
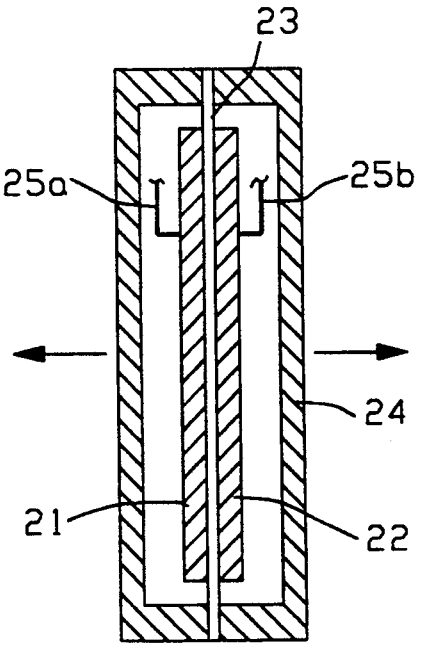
Figure 3A:
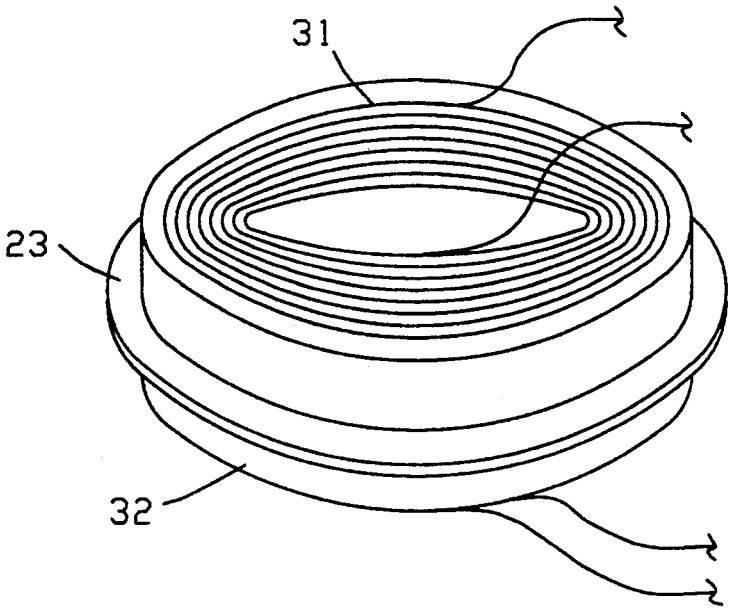
FIGS. 3A–3C are diagrams of an acoustic wave particle acceleration sensor utilizing fiber optic coils.
Figure 3B:
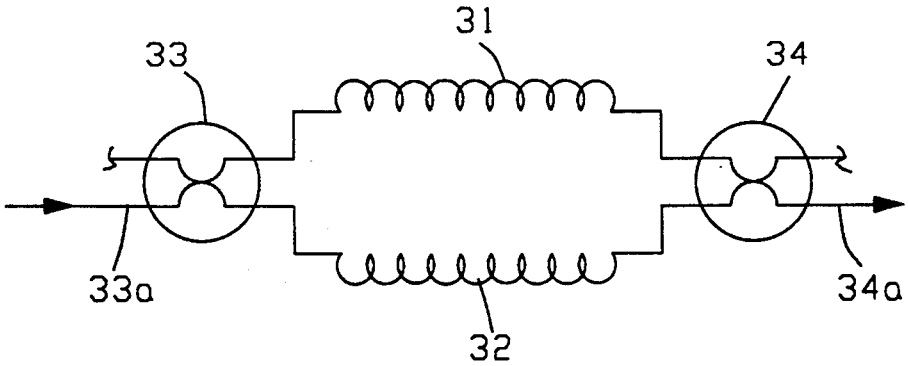

A fiber optic acoustic particle acceleration sensor is shown in FIGS. 3A and 3B, wherein previously referenced elements bare the originally assigned referenced numerals. Optical fiber coils 31 and 32, each containing a multiplicity of coil turns are mounted on opposite surfaces a flexible disk 23, yet to be described. The disk 23 may be mounted in a housing 24 as shown in FIG. 2D. An optical interferometer is formed by coupling light from an input terminal 33*a*, through a beam splitter 33, equally to one end of each coil 31 and 32. Light emitted from the other ends of the fiber optic coils 31 and 32 are combined by a beam combiner to provide a sum of the two beams, at an output terminal 34*a*, after a traversal of the optical fibers 31 and 32. When the coils 31 and 32 are of equal length the optical signals coupled through the fiber optic coils 31 and 32, due to the optical signal coupled to the input terminal 33*a*, are in phase at the output terminal 34*a*, providing a signal at the output terminal 34*a* with an amplitude that is twice that of the individual amplitudes. If the optical signals traversing the coils 31 and 32 are unequally phase shifted, an optical signal will be coupled to the output terminal 34*a* with an amplitude which less than twice the individual amplitudes. The decrease in amplitude being representative of the relative phase shift between the two coils. If the phase difference is due to a differential in length $\Delta L$, the optical signal output s(t) may be represented as:

$$s(t)=2A\cos(\beta\Delta L/2)\sin(wt)$$

Figure 3C:
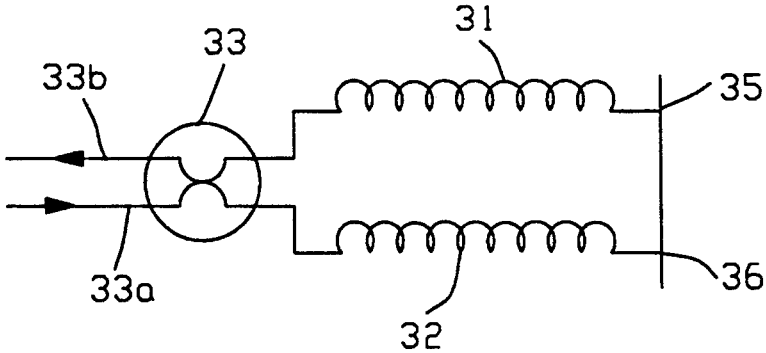

Where:

A is the amplitude of each optical fiber output signal $\beta$ is the phase constant of the fibers w/c w is the radian frequency of the optical signal c is the velocity of light in the optical fibers The interferometer shown in FIG. 3B may be shortened by eliminating the second coupler 34 and terminating the fibers 31 and 32 with mirrors 35 and 36, respectively, as shown in FIG. 3C, to establish a Michelson type interferometer. As previously described, light coupled to the input terminal 33*a* will split evenly between the fibers 31 and 32. The light coupled to each fiber will propagate to the mirror, be reflected therefrom back to the coupler 33 whereat the light in the fibers combine and split equally between terminals 33*a* and 33*b*. When the fibers 31 and 32 are of equal length, the light signals coupled from these fibers to the output terminals are in phase, creating a maximum amplitude signal at the output terminal 33*b*. Since light traverses the optical fibers twice (once in each direction), the optical signal output s(t) will be $$s(t)=2A\cos(\beta\Delta L)\sin(wt)$$

Figure 4:
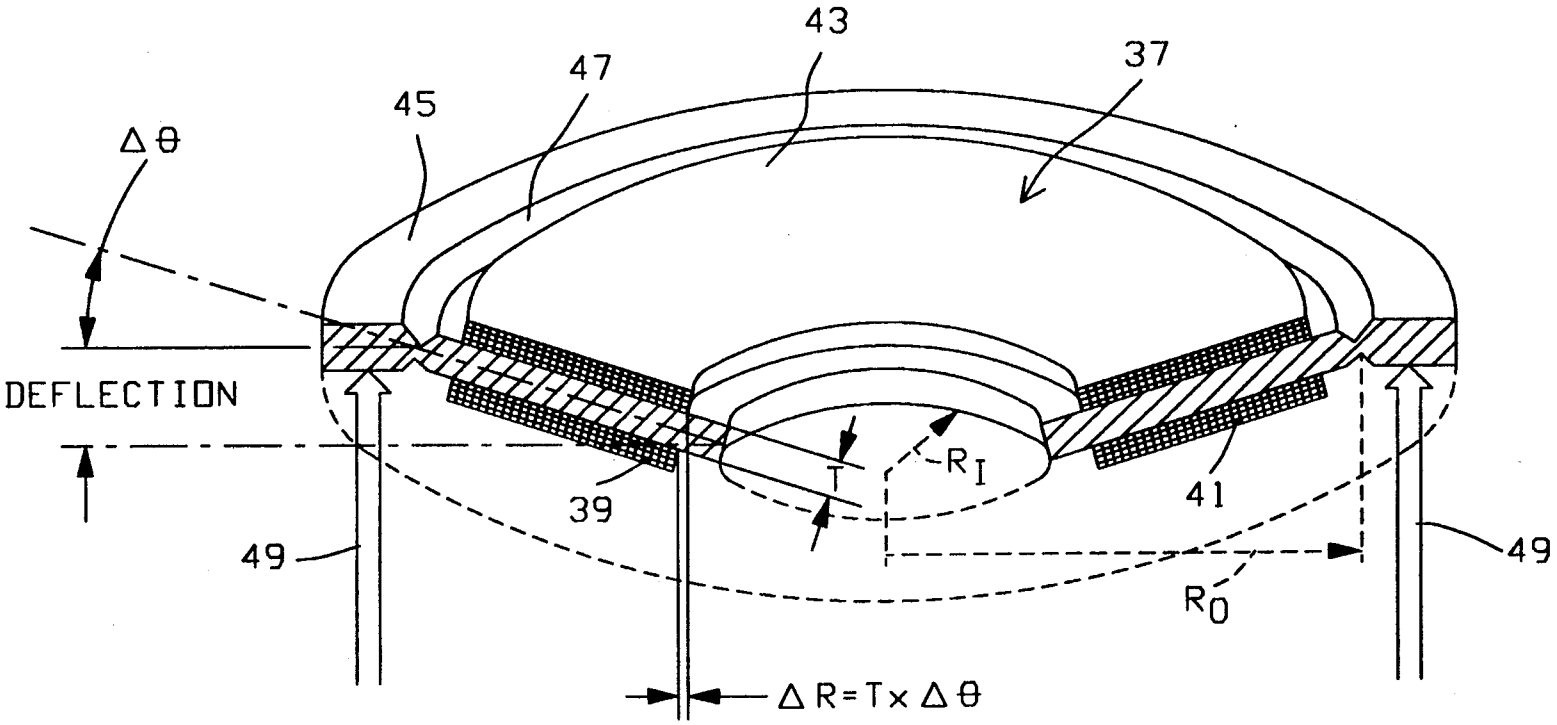
FIG. 4 is an illustration of a mounting for the piezo-electric discs and fiber optic coils.

The differential in length ΔL may be realized when one coil is elongated or compressed relative to the other. Such an elongation or compression may be obtained due to an acceleration of the housing by mounting the coils on the flexible disk 23, constructed as shown in FIG. 4. An annular disk-coil assembly 37, comprising an annular disk 39 and coils 41 and 43 respectively mounted on the upper and lower surfaces of the disk 39, is simply supported along its outer circumference by an annular support 45 via an annular spring 47. The annular spring 47 maybe formed by under cutting the two surfaces of a disk having a diameter greater than the outer diameter $2R_0$ of the annular disk 39. When the annular support 45 is subjected to an acceleration 49 normal to the plane of the disk-coil assembly 37, the disk-coil assembly 37 deflects from the annular spring 47 causing one coil to elongate and the other to compress. Which coil is elongated and which is compressed depends upon the direction of the acceleration. The acceleration 49 direction shown in FIG. 4 causes the upper coil 43 to elongate, and the lower coil 41 to compress. The difference in length ΔL is a function of the deflection angle 0, the thickness T of the annular disk 39, the inner radius Ri and the outer radius $R_0$, and the number of turns N in the coils 41 and 43. This length differential is given by:

$$\Delta L = 2\pi NT\theta$$

where:

$$\theta = \frac{K}{E(R_0^2 - R_I^2)}(R_0/T)^3(1-u^2)ma$$

E and u are Young's modulus and Poisson's ratio, respectively, constants that are related to the disk 39 material, m is the mass of the disk-coil assembly 37, T is the disk thickness, and "a" is the acceleration applied to the annular support 45. The constant K varies with the dimensions of the annular disk 39 being between 0.42 and 0.45 for ratios $R_I/R_0$ between 0.3 and 0.5. This deflection angle is essentially uniform over the entire disk for $R_I/R_0$ approximately equal to 0.4.

It is well known that an individual acoustic sensor has a broad acoustic beamwidth with a concomitant low directivity. The acoustic particle acceleration sensor, described above, is a class of acoustic sensor and exhibits the same characteristics. To obtain a narrower beamwidth and higher directivity it is necessary to array a multiplicity of acoustic sensors. Such an array, when mounted at or near an acoustic noise source is adversely effected by the acoustic noise emanating from the source and acoustic evanescent waves, generated by the flexures of the source. Consequently, care must be taken to isolate the sensors from the acoustic radiation and evanescent waves.

Vibrations of the noise source propagate along the source as flexural waves. These waves have a frequency dependent propagation velocity which is generally lower than the acoustic velocity in the propagating medium. Because of this velocity difference, the pressure disturbances due the noise source vibration cannot radiate into the medium. Thus evanescent waves are established. Pressure fields generated by such waves drop off rapidly with distance from the noise source, disappearing within a few inches. Consequently, positioning an acoustic sensor a short distance from the noise source effectively decouples it from the evanescent waves.

Acoustic radiation, generated when the noise source flexural waves encounter a stiffness discontinuity, maintain relatively high levels at great distances from the noise source. Isolation of an acoustic sensor from these waves may be realized by positioning a low acoustic impedance layer between the acoustic sensor and the acoustic noise source. It should be noted that all references herein to "low" and "high" acoustic impedance are relative to the acoustic impedance of the propagating medium.

Figure 5A:
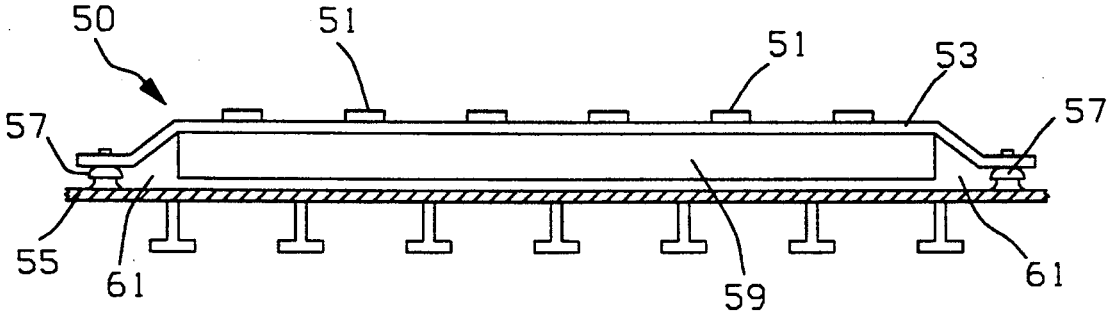
FIGS. 5A and 5B are diagrams of arrays of acoustic wave particle acceleration sensors.

Refer now to FIG. 5A, wherein a cross section of an array of acoustic particle acceleration sensors 51, mounted on a baffle 50 adjacent to a metallic plate noise source 55, is shown. The baffle 50 may comprise a structural mounting plate 53 made of a material exhibiting high flexural stiffness coupled to the metallic plate 55 through vibration isolators 57 to decouple the mounting plate 53 and the array elements 51 from the metallic plate vibrations. Isolation from the acoustic radiation generated by the plate vibrations may be provided by a low acoustic impedance baffle 59, which reflects the radiated acoustic waves, thus isolating the sensors 51 from the radiated noise. This low acoustic impedance baffle is made of a material having, or is constructed to exhibit, a low effective bulk modulus and/or low average density. These materials are chosen to provide low acoustic impedance relative to the metallic plate and are therefore effective reflectors of acoustic waves radiated due to plate flexures. When mounted close to the plate, however, such baffles flex with flexures of the metallic plate and transmit plate accelerations to the sensors. To prevent the acceleration transmissions from the metallic plate 55 to the mounting plate 53, the mounting plate 53 is constructed with a material having sufficient flexural stiffness to counter the metallic plate 55 induced flexures of the baffle 59.

Figure 5B:
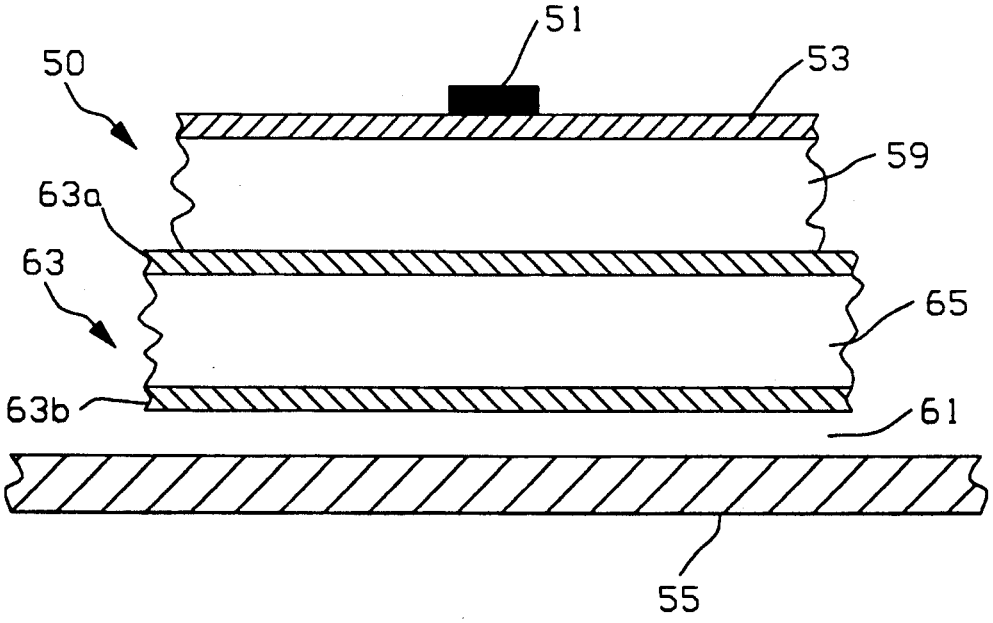

Although flexural stiff, the mounting plate is a low acoustic impedance to compressional waves and the acoustic particle acceleration at the medium side of the baffle is in fact twice that of the particle acceleration in a wave incident from the medium. Flexural stiffness may be realized by the construction of FIG. 5A or by adding another stiffening member 63 as shown in FIG. 5B, wherein elements previously discussed bear the originally assigned reference numerals. In the construction of FIG. 5B the stiffening member is placed on the metallic plate 55 side of the baffle 50, and may include a foam core 65 reinforced with outer skins 63*a* and 63*b*, which may be metal or plastic.

It should be recognized that evanescent waves due to metallic plate 55 flexures attenuate rapidly with distance from the metallic plate. To provide isolation from such waves, the vibration isolators 57 may be designed to position the baffle 59 at a distance 61 from the metallic plate 55 whereat the evanescent waves are substantially attenuated. This separation of the baffle 59 from the metallic plate 55 provides an additional advantage in that it reduces the flexures of the baffle caused by flexures of the metallic plate.

While the invention has been described in its preferred embodiments, it is to be understood that the words which have been used are words of description rather than limitation and that changes may be made within the purview of the appended claims without departing from the true scope and spirit of the invention in its broader aspects.

I claim:

1. An apparatus for sensing acoustic waves adjacent to an acoustic noise radiating surface of the type including an acoustic baffle having alternate layers of high and low acoustic impedance, the acoustic baffle constructed and arranged to be positioned with one surface adjacent to the acoustic noise radiating surface, comprising:

acoustic sensors mounted on a mounting surface on said acoustic baffle, said mounting surface positioned opposite said one surface and constructed to provide high flexural stiffness; and vibration isolators having a first end coupled to said mounting surface and a second end constructed for coupling to said acoustic noise radiating surface;

said mounting surface and vibration isolators constructed and arranged to decouple said acoustic sensors from vibrations of said acoustic noise radiating surface.

2. An apparatus in accordance with claim 1 wherein said sensor means includes an acoustic particle acceleration sensor responsive to particle accelerations of an incident acoustic wave propagating in a medium surrounding said sensor means.

3. An apparatus in accordance with claim 2 wherein said acoustic particle acceleration sensor includes:

a housing having outer surfaces exposed to said surrounding medium and having an inner chamber;

an annular disk having first and second surfaces extending between an inner diameter and an outer diameter, said annular disk having thickness between said first and second surfaces, and said surfaces having a radial dimension that is much greater than said thickness, said annular disk mounted between opposite walls of said inner chamber in a manner such that said annular disk deflects with accelerations of said acoustic particles at angles that are representative of said accelerations of said acoustic particles; and an optic interferometer having first and second fiber optic coils mounted respectively on said first and second surfaces of said annular disk and responsive to deflections thereof to establish differential optical signal phase shifts between said first and second optic fibers with angle phase deflections of said annular disk, thereby providing optical signal representations of accelerations of said acoustic particles.

4. An apparatus in accordance with claim 3 wherein said acoustic particle acceleration sensor has a density substantially equal to said surrounding medium.

5. An apparatus in accordance with claim 4 wherein said sensor means includes:

a housing having outer surfaces exposed to said surrounding medium and having an inner chamber;

a mass in said inner chamber;

spring means coupled to said housing for supporting said mass in said inner chamber; and transducer means coupled to said mass for providing signals representative of acoustic particle acceleration in response to movement of said mass.

6. An apparatus in accordance with claim 4 wherein said sensor means includes:

a housing having outer surfaces exposed to said surrounding medium and having an inner chamber;

a disk extending between opposite walls of said inner chamber and coupled to said housing in a manner to flex with acceleration of said acoustic particles; and distributed constant means coupled to said disk and responsive to flexures thereof for providing signals representative of said acceleration of said acoustic particles.

7. An apparatus in accordance with claim 6 wherein said distributed constant means includes piezo-electric means mounted on said disk for providing electrical signals representative of acceleration of said acoustic particles.

8. An apparatus in accordance with claim 7 wherein said piezo-electric means includes first and second piezo-electric elements respectively mounted on first and second sides of said disk.

9. An apparatus in accordance with claim 8 wherein said first and second piezo-electric elements are mounted on said disk to establish electrical signals in phase opposition and coupled to provide an electrical signal at output electrical terminals that is twice that provided by each piezo-electric element individually.

10. An apparatus in accordance with claim 3 wherein said first and second fiber optic coils each have an input end and an output end and further including first and second beam splitters coupled respectively to said input and output ends of said first and second fiber optic coils.

11. An apparatus in accordance with claim 3 wherein said first and second fiber optic coils each have an input end and and output end and further including:

a beam splitter coupled to said input ends of said fiber optic coils; and first and second mirrors coupled respectively to output ends of said first and second fiber optic coils.

12. An acoustic particle acceleration sensor comprising:

a housing having outer surfaces exposed to said surrounding medium and having an inner chamber;

an annular disk having first and second surfaces extending between an inner diameter and an outer diameter, said annular disk having thickness between said first and second surfaces, and said surfaces having a radial dimension that is much greater than said thickness, said annular disk mounted between opposite walls of said inner chamber in a manner such that said annular disk deflects with accelerations of said acoustic particles at angles that are representative of said accelerations of said acoustic particles; and an optic interferometer having first and second fiber optic coils mounted respectively on said first and second surfaces of said annular disk and responsive to deflections thereof to establish differential optical signal phase shifts between said first and second optic fibers with angle deflections of said annular disk, thereby providing optical signal representations of accelerations of said acoustic particles.

13. An apparatus in accordance with claim 12 wherein said optic interferometer means includes first and second beam splitters coupled respectively to said input and output ends of said first and second fiber optic coils.

14. An apparatus in accordance with claim 12 wherein said optic interferometer means includes a beam splitter coupled to said input ends of said fiberoptic coils; and first and second mirrors coupled respectively to output ends of said first and second fiber optic coils.

* * * * *